US009683763B2

(12) United States Patent
Maruyama

(10) Patent No.: US 9,683,763 B2
(45) Date of Patent: Jun. 20, 2017

(54) COMPRESSOR AND COOLING SYSTEM

(71) Applicant: Sumitomo Heavy Industries, Ltd., Tokyo (JP)

(72) Inventor: Toru Maruyama, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 340 days.

(21) Appl. No.: 14/337,804

(22) Filed: Jul. 22, 2014

(65) Prior Publication Data

US 2015/0027155 A1 Jan. 29, 2015

(30) Foreign Application Priority Data

Jul. 23, 2013 (JP) ..... 2013-152899

(51) Int. Cl.
*F25B 13/00* (2006.01)
*F25B 31/00* (2006.01)

(52) U.S. Cl.
CPC ..... *F25B 31/006* (2013.01); *F25B 31/004* (2013.01); *F25B 2500/04* (2013.01)

(58) Field of Classification Search
CPC .. F25B 31/006; F25B 31/004; F25B 2500/04; F25B 41/04; Y10T 137/4252
USPC ..... 62/50.4, 470, 55.5; 137/239
See application file for complete search history.

(56) References Cited

U.S. PATENT DOCUMENTS 4,063,588 A * 12/1977 Thorogood ..... F25J 5/00 137/240
4,751,823 A * 6/1988 Hans ..... F24D 17/02 237/2 B
5,010,737 A * 4/1991 Okumura ..... F25B 9/10 62/55.5
5,495,723 A * 3/1996 MacDonald ..... F24D 17/02 62/183
7,555,911 B2 * 7/2009 Tanaka ..... F04B 37/08 62/228.1
2003/0024252 A1 * 2/2003 Funayama ..... B01D 8/00 62/55.5

(Continued)

FOREIGN PATENT DOCUMENTS

CN 1545604 A 11/2004
CN 2669046 Y 1/2005

(Continued)

*Primary Examiner* — Jianying Atkisson
*Assistant Examiner* — Kun Kai Ma
(74) *Attorney, Agent, or Firm* — Michael Best & Friedrich LLP

(57) ABSTRACT

A compressor includes: a heat exchanger configured to discharge heat generated during compression outside the compressor; a cooling liquid inlet port through which cooling liquid flowing from outside the compressor into the compressor passes; and a cooling liquid outlet port through which the cooling liquid flowing out of the compressor from inside the compressor passes. The compressor is configured such that an operation mode is switchable between a first mode in which the cooling liquid passing through the cooling liquid inlet port flows in the heat exchanger in a predetermined first direction and passes through the cooling liquid outlet port, and a second mode in which the cooling liquid passing through the cooling liquid inlet port flows in the heat exchanger in a second direction opposite to the first direction and passes through the cooling liquid outlet port.

9 Claims, 3 Drawing Sheets

(56) References Cited

U.S. PATENT DOCUMENTS

| | | | | |
|---|---|---|---|---|
| 2003/0034149 | A1 | 2/2003 | Harrison | |
| 2007/0199337 | A1* | 8/2007 | Otake | F24D 17/02 62/183 |
| 2007/0227973 | A1* | 10/2007 | Zha | B01D 63/02 210/636 |
| 2009/0119036 | A1* | 5/2009 | Jayanth | F04B 49/065 702/60 |
| 2010/0269538 | A1* | 10/2010 | Suzuki | B01D 46/0031 62/470 |
| 2011/0265820 | A1* | 11/2011 | Dahlberg | B08B 9/0321 134/10 |
| 2012/0125040 | A1* | 5/2012 | Matsui | B01D 39/06 62/470 |
| 2012/0255314 | A1* | 10/2012 | Matsui | F04B 37/08 62/55.5 |
| 2013/0025301 | A1* | 1/2013 | Maitani | F24D 11/0214 62/79 |
| 2013/0160468 | A1* | 6/2013 | Kimura | F25B 49/022 62/6 |

FOREIGN PATENT DOCUMENTS

| | | | |
|---|---|---|---|
| CN | 201607162 | U | 10/2010 |
| CN | 102052880 | A | 5/2011 |
| JP | S62-52300 | U | 4/1987 |
| JP | H04-100695 | U | 8/1992 |
| JP | 2002-333160 | A | 11/2002 |
| JP | 2006-284062 | A | 10/2006 |
| JP | 2009-079862 | A | 4/2009 |
| JP | 2011-127778 | A | 6/2011 |
| JP | 2011-190953 | A | 9/2011 |
| JP | 2012-017937 | A | 1/2012 |
| JP | 2012-107834 | A | 6/2012 |
| JP | 2012-141111 | A | 7/2012 |
| JP | 2013-210155 | A | 10/2013 |

* cited by examiner

COMPRESSOR AND COOLING SYSTEM

BACKGROUND OF THE INVENTION

1. Field of the Invention

The present invention relates to a compressor configured to compress gas returned from a refrigerator and supply the gas to the refrigerator and to a cooling system provided with the compressor.

2. Description of the Related Art

Gifford-McMahon (GM) refrigerators, pulse tube refrigerators, Stirling refrigerators, and Solvay refrigerators are capable of cooling a target object to a temperature ranging from a low temperature of about 100 K (Kelvin) to an extremely low temperature of 4 K. Such refrigerators are used to cool a superconducting magnet or a detector or used in cryopumps, etc.

The refrigerator is provided with a compressor for compressing helium gas used as an operating gas in the refrigerator. Cooling water or non-freezing liquid supplied from external refrigerant facilities to the compressor is used as a refrigerant for removing compression heat in the compressor. It is known in the related art that a rapid filter is subject to reverse cleaning.

The refrigerant line of a heat exchanger of the compressor may be clogged (blocked), depending on the quality of refrigerant from the refrigerant facilities. When the refrigerant line is clogged, the temperature of the compressor is increased due to insufficient heat exchange. When the temperature exceeds a predetermined level, the compressor comes to an abnormal stop. This causes the refrigerator to stop and may cause trouble in the operation plan of the system including the refrigerator.

Periodical cleaning or maintenance of the refrigerant line by the user of the system is recommended in order to overcome such trouble. In practice, however, the system is often left unmaintained until the refrigerator line is blocked, and the user often notices that the refrigerator line is clogged only after a trouble occurs.

SUMMARY OF THE INVENTION

In this background, an embodiment of the present invention addresses a need to provide a compressor capable of mitigating time-dependent reduction in the heat exchange capability of the installed heat exchanger and a cooling system provided with the compressor.

One embodiment of the present invention relates to a compressor. The compressor is configured to compress gas returned from a refrigerator and supply the gas to the refrigerator, and includes: a heat exchanger configured to discharge heat generated during compression outside the compressor; a cooling liquid inlet port through which cooling liquid flowing from outside the compressor into the compressor passes; and a cooling liquid outlet port through which the cooling liquid flowing out of the compressor from inside the compressor passes. The compressor is configured such that an operation mode is switchable between a first mode in which the cooling liquid passing through the cooling liquid inlet port flows in the heat exchanger in a predetermined first direction and passes through the cooling liquid outlet port, and a second mode in which the cooling liquid passing through the cooling liquid inlet port flows in the heat exchanger in a second direction opposite to the first direction and passes through the cooling liquid outlet port.

Another embodiment relates to a cooling system. The cooling system includes: a refrigerator using gas; and a compressor configured to compress the gas returned from the refrigerator and supply the gas to the refrigerator. The compressor includes: a heat exchanger configured to discharge heat generated during compression outside the compressor; a cooling liquid inlet port through which cooling liquid flowing from outside the compressor into the compressor passes; and a cooling liquid outlet port through which the cooling liquid flowing out of the compressor from inside the compressor passes. The compressor is configured such that an operation mode is switchable between a first mode in which the cooling liquid passing through the cooling liquid inlet port flows in the heat exchanger in a predetermined first direction and passes through the cooling liquid outlet port, and a second mode in which the cooling liquid passing through the cooling liquid inlet port flows in the heat exchanger in a second direction opposite to the first direction and passes through the cooling liquid outlet port.

Optional combinations of the aforementioned constituting elements, and implementations of the invention in the form of methods, apparatuses, and systems may also be practiced as additional modes of the present invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
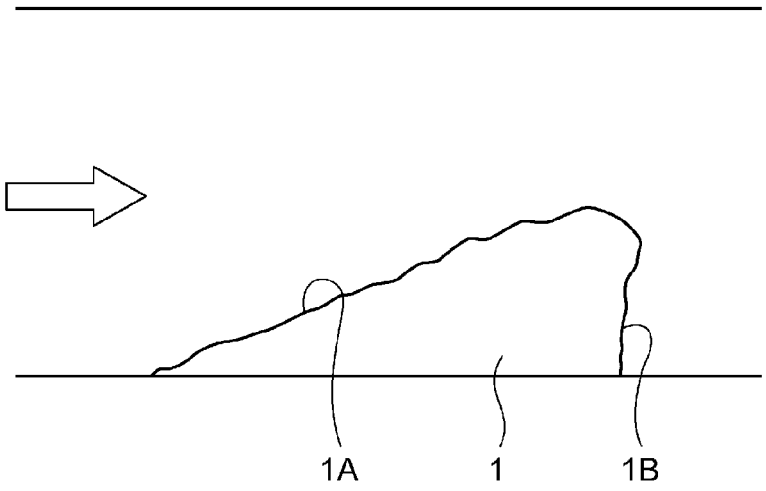
FIG. 1 shows a schematic cross section of a pipe in which a scale is attached inside the pipe.

The invention will now be described by reference to the preferred embodiments. This does not intend to limit the scope of the present invention, but to exemplify the invention.

Like numerals in the drawings represent like constituting elements, members or processes so that the description may be omitted as appropriate. For ease of understanding, the dimension of the members in the drawings may be shown on an enlarged or reduced scale as appropriate. Some of the members that may be less important for the purpose of describing the embodiments may not be shown in the drawings.

Foreign materials called scale are collected in the pipes in which the cooling water flows provided that the quality of cooling water is relatively poor. The scale grows progressively and could eventually clog the pipes.

FIG. 1 shows a schematic cross section of a pipe in which a scale 1 is attached. The bold arrow shows the direction of normal water flow. The scale 1 is mainly formed as rust, gelatinous substance, organic substance, or the like contained in the cooling water is collected. The surface 1A facing the flow of cooling water tends to be relatively hard. It is therefore relatively difficult to remove the scale 1 by increasing the water flow.

In contrast, the scale 1 could come off easily by reversing the direction of water flow because the scale 1 would then be scooped at a relatively soft surface 1B. In an embodiment, this phenomenon is taken advantage of such that the scale collected in the cooling water pipe of a water-cooled heat exchanger is reduced in volume or removed, by automatically reversing the direction of cooling water in a compressor provided with the heat exchanger. In this way, the system is designed to avoid a trouble in which the whole system is abruptly stopped due to clogging of the cooling water piping. Further, clogging of the cooling water piping or reduction in heat exchange capability can be mitigated or prevented without imposing an excessive task on a user.

Figure 2:
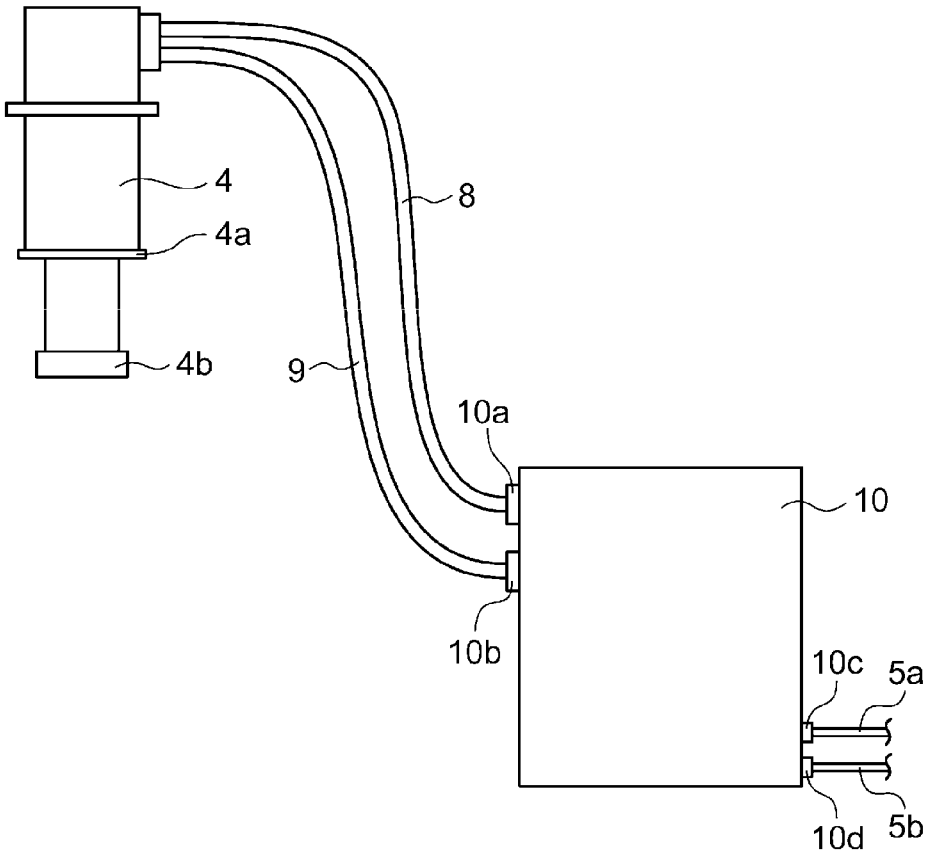
FIG. 2 is a schematic diagram showing a configuration of a refrigerator system provided with a compressor according to an embodiment.
Figure 3:
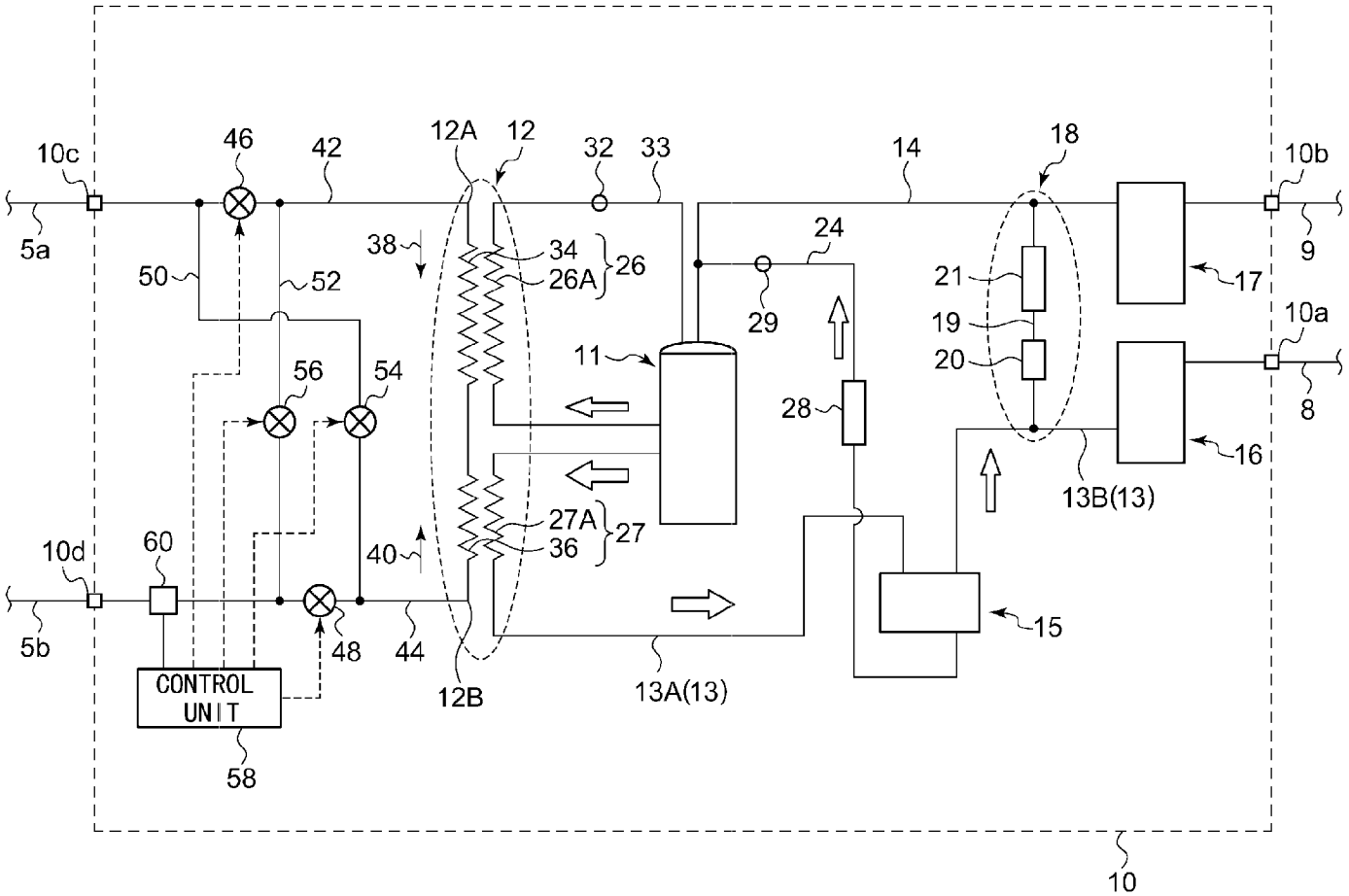
FIG. 3 shows a configuration of the compressor of FIG. 2.

FIG. 2 is a schematic diagram showing the configuration of a refrigerator system 2 provided with the compressor 10 according to the embodiment. The refrigerator system 2 is provided with a GM refrigerator 4 for cooling a target object and a compressor 10 coupled to the GM refrigerator 4 via two flexible pipes 8, 9. The GM refrigerator 4, the compressor 10, and the two flexible pipes 8, 9 constitute a cooling system that cools a subject of cooling.

The GM refrigerator 4 is a known two-stage GM refrigerator and may be configured by using the technology described in JP2011-190953 filed by the applicant previously. A first cooling stage 4*a* of the cold head of the GM refrigerator 4 may be mechanically coupled to a heat shield of the target object. A liquid helium bath may be formed in the heat shield. A second cooling stage 4*b* may be exposed above the liquid surface of the liquid helium in the liquid helium bath, i.e., exposed in the gas above the liquid helium.

While the refrigerator system 2 is running, the temperature of the heat shield is maintained at 40 K-50 K by the cooling performance of the GM refrigerator 4. The second cooling stage 4*b* maintains the pressure in the liquid helium bath at a prescribed level or below by re-condensing (liquefying) evaporating helium.

The high-pressure flexible pipe 8 supplies a high-pressure operating gas (e.g., helium gas) from the compressor 10 to the GM refrigerator 4. The low-pressure flexible pipe 9 supplies a low-pressure helium gas from the GM refrigerator 4 to the compressor 10.

The compressor 10 compresses the helium gas returning from the GM refrigerator 4 via the low-pressure flexible pipe 9 and supplies the compressed helium gas to the GM refrigerator 4 via the high-pressure flexible pipe 8. The compressor 10 is provided with a high-pressure port 10*a* coupled to the high-pressure flexible pipe 8, a low-pressure port 10*b* coupled to the low-pressure flexible pipe 9, and a cooling water inlet port 10*c* for receiving cooling liquid such as cooling water or non-freezing liquid from a cooling water circulating device (not shown) outside the compressor 10, and a cooling water outlet port 10*d* for discharging cooling water from the compressor 10. The ports are mounted on the housing of the compressor 10.

A cooling water supplying pipe 5*a* is coupled to the cooling water inlet port 10*c*. Cooling water of low temperature and high pressure from the cooling water circulating device flows through the cooling water supplying pipe 5*a* toward the compressor 10 and enters the compressor 10, passing through the cooling water inlet port 10*c*. A cooling water return pipe 5*b* is coupled to the cooling water outlet port 10*d*. Cooling water of high temperature and low pressure from the interior of the compressor 10 passes through the cooling water outlet port 10*d* and flows in the cooling water return pipe 5*b* toward the cooling water circulating device.

FIG. 2 shows the configuration of the compressor 10. The compressor 10 includes a compression capsule 11, a water-cooled heat exchanger 12, a high-pressure side pipe 13, a low-pressure side pipe 14, an oil separator 15, an adsorber 16, a storage tank 17, and a bypass mechanism 18. The compressor 10 pressurizes low-pressure helium gas returned from the GM refrigerator 4 via the low-pressure flexible pipe 9, using the compression capsule 11, and supplies the gas to the GM refrigerator 4 again via the high-pressure flexible pipe 8.

The helium gas returned from the GM refrigerator 4 flows into the storage tank 17 via the low-pressure flexible pipe 9. The storage tank 17 removes pulsation accompanying the returning helium gas. Because the storage tank 17 has a relatively large volume, the pulsation can be dampened or removed by introducing the helium gas into the storage tank 17.

The helium gas having the pulsation dampened or removed in the storage tank 17 is guided to the low-pressure side pipe 14. The low-pressure side pipe 14 is coupled to the compression capsule 11. Therefore, the helium gas having the pulsation dampened or removed in the storage tank 17 is supplied to the compression capsule 11.

The compression capsule 11 is a scroll pump or a rotary pump, for example, and compresses and pressurizes the helium gas in the low-pressure side pipe 14. The compression capsule 11 delivers the helium gas with a raised pressure to the high-pressure side pipe 13A (13). The helium gas is pressurized in the compression capsule 11 and delivered to the high-pressure side pipe 13A (13) such that oil in the compression capsule 11 is mixed in the gas in a small amount.

The compression capsule 11 is configured to be cooled by using oil. Therefore, an oil cooling pipe 33 for circulating oil is coupled to an oil heat exchanger 26 included in the water-cooled heat exchanger 12. Further, an orifice 32 for controlling the flow rate of oil flowing inside is provided in the oil cooling pipe 33.

The water-cooled heat exchanger 12 exchanges heat to discharge heat generated in compressing the helium gas in the compression capsule 11 (hereinafter, referred to as compression heat) outside the compressor 10. The water-cooled heat exchanger 12 is provided with an oil heat exchanger 26 for cooling the oil flowing in the oil cooling pipe 33 and a gas heat exchanger 27 for cooling the pressurized helium gas.

The oil heat exchanger 26 is provided with a part 26A of the oil cooling pipe 33 in which oil flows and a first cooling water pipe 34 in which cooling water flows. The oil heat exchanger 26 is configured such that heat is exchanged between the part 26A and the first cooling water pipe 34. The oil discharged from the compression capsule 11 to the oil cooling pipe 33 is at a high temperature due to the compression heat. As the high-temperature oil passes through the oil heat exchanger 26, the heat of the oil is transferred to the cooling water by heat exchange so that the temperature of the oil exiting the oil heat exchanger 26 becomes lower than the temperature of the oil entering the oil heat exchanger 26. In other words, the compression heat is transferred to the cooling water via the oil flowing in the oil cooling pipe 33 and discharged outside.

The gas heat exchanger 27 is provided with a part 27A of the high-pressure side pipe 13A in which high-pressure helium gas flows and a second cooling water pipe 36 in which the cooling water flows. In the gas heat exchanger 27, as in the oil heat exchanger 26, the compression heat is transferred to the cooling water via the helium gas flowing in the high-pressure side pipe 13A (13) and discharged outside.

The first cooling water pipe 34 and the second cooling water pipe 36 are coupled in series. An end of the first cooling water pipe 34 functions as a cooling water receiving port 12A of the water-cooled heat exchanger 12. The other end of the first cooling water pipe 34 is coupled to one end of the second cooling water pipe 36. The other end of the second cooling water pipe 36 functions as a cooling water discharge port 12B of the water-cooled heat exchanger 12.

The operation mode of the compressor 10 is switchable between a normal mode in which the cooling water passing through the cooling water inlet port 10*c* flows in the water-cooled heat exchanger 12 in a predetermined first direction 38 and passes through the cooling water outlet port 10*d*, and a reverse cleaning mode in which the cooling water passing through the cooling water inlet port 10*c* flows in the water-cooled heat exchanger 12 in a second direction 40 opposite to the first direction 38 and passes through the cooling water outlet port 10*d*.

The water-cooled heat exchanger 12 is configured such that the efficiency of heat exchange in the water-cooled heat exchanger 12 differs depending on the direction of flow of cooling water. In particular, the efficiency of heat exchange occurring when the cooling water flows in the first direction 38 is higher than the efficiency of heat exchange occurring when the cooling water flows in the second direction 40. In other words, the efficiency of heat exchange in the water-cooled heat exchanger 12 in the reverse cleaning mode is lower than the efficiency of heat exchange in the water-cooled heat exchanger 12 in the normal mode.

The compressor 10 is provided with a first pipe 42 coupling the cooling water inlet port 10*c* to the cooling water receiving port 12A, a second pipe 44 coupling the cooling water outlet port 10*d* to the cooling water discharge port 12B, a first valve 46 mounted in the first pipe 42 and regulating the flow of cooling water through the first pipe 42, a second valve 48 mounted in the second pipe 44 and regulating the flow of cooling water through the second pipe 44, a third pipe 50 coupling the port of the first valve 46 toward the cooling water inlet port 10*c* to the port of the second valve 48 toward the cooling water discharge port 12B, a fourth pipe 52 coupling the port of the first valve 46 toward the cooling water receiving port 12A to the port of the second valve 48 toward the cooling water outlet port 10*d*, a third valve 54 mounted in the third pipe 50 and regulating the flow of cooling water through the third pipe 50, a fourth valve 56 mounted in the fourth pipe 52 and regulating the flow of cooling water through the fourth pipe 52, a control unit 58, and a measuring unit 60.

The valves may be configured as automatic on-off electromagnetic valves that open or close in accordance with a control signal. The measuring unit 60 is provided on a segment of the second pipe 44 between the second valve 48 and the cooling water outlet port 10*d*. The measuring unit 60 measures the flow rate and temperature of the cooling water flowing out of the cooling water outlet port 10*d* and reports the measurements to the control unit 58. The first direction 38 goes from the cooling water receiving port 12A to the cooling water discharge port 12B, and the second direction 40 goes from the cooling water discharge port 12B to the cooling water receiving port 12A.

The control unit 58 generates control signals for controlling the on and off of the first valve 46, the second valve 48, the third valve 54, and the fourth valve 56 and sends the control signals to the respective valves. The control unit 58 controls the valves such that the first valve 46 and the second valve 48 are opened and the third valve 54 and the fourth valve 56 are closed in the normal mode. The control unit 58 controls the valves such that the third valve 54 and the fourth valve 56 are opened and the first valve 46 and the second valve 48 are closed in the reverse cleaning mode.

As a result, the cooling water flow in a path connecting the cooling water inlet port 10*c*, the cooling water receiving port 12A, the cooling water discharge port 12B, and the cooling water outlet port 10*d* in the stated order in the normal mode, and flows in a path connecting the cooling water inlet port 10*c*, the cooling water discharge port 12B, the cooling water receiving port 12A, and the cooling water outlet port 10*d* in the stated order in the reverse cleaning mode.

During the operation of the compressor 10, the control unit 58 switches the operation mode between the normal mode and the reverse cleaning mode based on the measurement of the flow rate or temperature of the cooling water measured by the measuring unit 60 or on the measurements of both. In particular, the control unit 58 controls the operation mode from the normal mode to the reverse cleaning mode when the flow rate of cooling water measured drops below a first threshold value. The control unit 58 controls the operation mode from the reverse cleaning mode to the normal mode when the flow rate of cooling water measured in the reverse cleaning mode exceeds a second threshold value.

The control unit 58 may switch the operation mode between the normal mode and the reverse cleaning mode at intervals (e.g., according to a timing schedule or periodically) alternative to or in addition to controlling the operation mode based on measurements.

Electromagnetic valves are configured as being normally open or normally closed. Normally closed electromagnetic valves are employed as the first valve 46 and the second valve 48, and normally open electromagnetic valves are employed as the third valve 54 and the fourth valve 56. When the primary power supply of the compressor 10 is turned off and the compressor 10 is stopped accordingly, power supply to the valves is also stopped. As the compressor 10 is stopped, the first valve 46 and the second valve 48 are closed, and the third valve 54 and the fourth valve 56 are opened, activating the reverse cleaning mode.

The helium gas pressurized in the compression capsule 11 and cooled by the gas heat exchanger 27 is supplied to the oil separator 15 via the high-pressure side pipe 13A (13). The oil separator 15 separates oil contained in the helium gas and removes impurities and dust contained in the oil.

The helium gas with oil removed by the oil separator 15 is delivered to the adsorber 16 via the high-pressure side pipe 13B (13). The adsorber 16 is specifically designed to remove the gasified oil component contained in the helium gas. Once the gasified oil component is removed in the adsorber 16, the helium gas is guided to the high-pressure flexible pipe 8 and supplied thereby to the GM refrigerator 4.

The bypass mechanism 18 is provided with a bypass pipe 19, a high-pressure side pressure detector 20, and a bypass valve 21. The bypass pipe 19 communicates the high-pressure side pipe 13B with the low-pressure side pipe 14. The high-pressure side pressure detector 20 detects the pressure of the helium gas in the high-pressure side pipe 13B. The bypass valve 21 is an electric-powered valve device to open and close the bypass pipe 19. The bypass valve 21 is configured as a normally closed valve controlled to be driven by the high-pressure side pressure detector 20.

More specifically, the bypass valve 21 is configured to be driven by the high-pressure side pressure detector 20 so as to be opened, when the high-pressure side pressure detector 20 detects that the pressure of the helium gas in a path between the oil separator 15 and the adsorber 16, i.e., the pressure in the high-pressure side pipe 13B, is a prescribed pressure or higher. This reduces the likelihood that supply gas at a prescribed pressure or higher is supplied to the GM refrigerator 4.

The high-pressure side of an oil return pipe 24 is coupled to the oil separator 15 and the low-pressure side thereof is coupled to the low-pressure side pipe 14. In the middle of the oil return pipe 24 are provided a filter 28 for removing dust contained in the oil separated by the oil separator 15 and an orifice 29 for controlling the amount of oil returned.

A description will now be given of the operation of the compressor 10 configured as described above. During the operation of the compressor 10, the measuring unit 60 monitors the flow rate of cooling water in the normal mode. When the flow rate of cooling water drops below the first threshold value, the control unit 58 switches the first valve 46 and the second valve 48 from the opened state to the closed state and switches the third valve 54 and the fourth valve 56 from the closed state to the opened state. This switches the operation mode from the normal mode to the reverse cleaning mode.

In the reverse cleaning mode, the measuring unit 60 monitors the flow rate of cooling water. When the flow rate of cooling water exceeds the second threshold value, the control unit 58 switches the first valve 46 and the second valve 48 from the closed state to the opened state and switches the third valve 54 and the fourth valve 56 from the opened state to the closed state. This switches the operation mode from the reverse cleaning mode to the normal mode.

According to the compressor 10 of the embodiment, the direction of cooling water flowing in the first cooling water pipe 34 and the second cooling water pipe 36 of the water-cooled heat exchanger 12 is automatically reversed. Accordingly, the scale collected in the first cooling water pipe 34 and the second cooling water pipe 36 can be effectively discharged outside without requiring an excessive work on the user of the refrigerator system 2. As a result, clogging of the first cooling water pipe 34 and the second cooling water pipe 36 can be mitigated and the heat exchange efficiency of the water-cooled heat exchanger 12 in the normal mode can be maintained.

This can reduce the likelihood of abnormal stop of the compressor 10 due to a trouble related to cooling water. Therefore, the likelihood that the maintenance plan of the refrigerator system 2 is affected is reduced and the operation of the refrigerator system 2 can be stably continued. Moreover, the compressor 10 can be automatically returned to normal even if it is stopped due to clogging of the cooling water piping so that the operation of the refrigerator system 2 is prevented from being adversely affected.

The operation mode of the compressor 10 according to the embodiment is switched based on the flow rate of the cooling water measured. This can implement more efficient measures to address clogging than the related art by automating the process of executing reverse cleaning when clogging is suspected and returning the operation to normal when clogging is removed. In other words, necessary counter measures can be taken automatically as they are needed.

In further accordance with the compressor 10 according to the embodiment, the operation mode can be switched while the compressor 10 is being run. Therefore, the compressor 10 need not be stopped to remove or prevent clogging of the cooling water piping so that the down time of the compressor 10, and, eventually, the down time of the refrigerator system 2, can be reduced.

Further, periodical switching of the operation mode of the compressor 10 according to the embodiment is expected to prevent clogging.

The reverse cleaning mode is activated when the compressor 10 according to the embodiment is not in operation. Efficiency of heat exchange is not important while the compressor 10 is not in operation. Removal of the scale by reverse cleaning performed during such a period improves the efficiency.

Described above are the compressor 10 according to the embodiment and the refrigerator system 2 provided with the compressor 10. The embodiment is intended to be illustrative only and it will be obvious to those skilled in the art that various modifications to constituting elements and processes could be developed and that such modifications are also within the scope of the present invention.

The embodiment is described as using the GM refrigerator 4 by way of example. However, the type of refrigerator is non-limiting. The technical concept according to the embodiment may be applicable to a compressor configured to supply an operating gas to a refrigerator. For example, the refrigerator may be a pulse tube refrigerator of GM type or Stirling type, or a Stirling refrigerator, or a Solvay refrigerator.

For example, the cooling system may be used as a cooling means or a liquefying means in an MRI system, a superconducting magnet, a cryopump, an X-ray detector, an infrared sensor, a quantum photon detector, a semiconductor detector, a dilution refrigerator, an He3 refrigerator, an adiabatic demagnetization refrigerator, a helium liquefier, a cryostat, etc.

The operation mode according to the embodiment is described as being switched based on the flow rate measured by the measuring unit 60, but the manner of switching is non-limiting. For example, the operation mode may be switched based on the temperature measured by the measuring unit 60 in addition to or in place of the flow rate. In case a layer of scale is stuck to the pipe wall of the cooling water piping, the flow rate may not drop seriously but the efficiency of heat exchange may drop radically. Reduction in heat exchange efficiency shows up in the form of an increase in the temperature of the discharged cooling water. Accordingly, the scale is removed efficiently by monitoring the temperature of discharged cooling water and switching the operation mode accordingly.

The operation mode according to the embodiment is described as being switched during the operation of the compressor 10, but the timing of switching is non-limiting. For example, the operation mode may be switched after the compressor 10 is stopped.

The operation mode is described as being switched when the flow rate of cooling water measured goes higher or lower than a threshold value, but the timing of switching is non-limiting. For example, a duration of time may be provided for determination against a threshold value. More particularly, the operation mode may be switched when the flow rate goes higher or lower than the threshold value and the status is continued for a predetermined period of time.

It should be understood that the invention is not limited to the above-described embodiment, but may be modified into various forms on the basis of the spirit of the invention. Additionally, the modifications are included in the scope of the invention.

Priority is claimed to Japanese Patent Application No. 2013-152899, filed on Jul. 23, 2013, the entire content of which is incorporated herein by reference.

What is claimed is:

1. A compressor configured to compress gas returned from a refrigerator and supply the gas to the refrigerator, comprising:

a heat exchanger configured to discharge heat generated during compression outside the compressor;

a cooling liquid inlet port through which cooling liquid flowing from outside the compressor into the compressor passes;

a cooling liquid outlet port through which the cooling liquid flowing out of the compressor from inside the compressor passes;

a first pipe configured to couple the cooling liquid inlet port to a cooling liquid receiving port of the heat exchanger;

a second pipe configured to couple the cooling liquid outlet port to a cooling liquid discharge port of the heat exchanger;

a first valve mounted in the first pipe and configured to regulate a flow of the cooling liquid through the first pipe;

a second valve mounted in the second pipe and configured to regulate a flow of the cooling liquid through the second pipe;

a third pipe configured to couple a port of the first valve toward the cooling liquid inlet port to a port of the second valve toward the cooling liquid discharge port;

a fourth pipe configured to couple a port of the first valve toward the cooling liquid receiving port to a port of the second valve toward the cooling liquid outlet port;

a third valve mounted in the third pipe and configured to regulate a flow of the cooling liquid through the third pipe; and a fourth valve mounted in the fourth pipe and configured to regulate a flow of the cooling liquid through the fourth pipe, wherein the compressor is configured such that an operation mode is switchable between a first mode in which the cooling liquid passing through the cooling liquid inlet port flows in the heat exchanger in a predetermined first direction and passes through the cooling liquid outlet port, and a second mode in which the cooling liquid passing through the cooling liquid inlet port flows in the heat exchanger in a second direction opposite to the first direction and passes through the cooling liquid outlet port, in the first mode, the first valve and the second valve allow passage of the cooling liquid and the third valve and the fourth valve restrict a flow of the cooling liquid, and, in the second mode, the third valve and the fourth valve allow passage of the cooling liquid and the first valve and the second valve restrict a flow of the cooling liquid.

2. The compressor according to claim 1, wherein an efficiency of heat exchange in the heat exchanger in the second mode is lower than the efficiency of heat exchange in the heat exchanger in the first mode.

3. The compressor according to claim 2, further comprising:

a control unit configured to switch the operation mode between the first mode and the second mode based on a result of measurement of a flow rate or a temperature of the cooling liquid, or measurements of both.

4. The compressor according to claim 3, wherein the control unit switches the operation mode from the first mode to the second mode when the flow rate of the cooling liquid measured drops below a first predetermined threshold value, and switches the operation mode from the second mode to the first mode when the flow rate of the cooling liquid measured exceeds a second threshold value.

5. The compressor according to claim 3, wherein the control unit switches the operation mode between the first mode and the second mode during an operation of the compressor.

6. The compressor according to claim 3, wherein the control unit switches the operation mode between the first mode and the second mode periodically.

7. The compressor according to claim 1, wherein the second mode is activated while the compressor is not in operation.

8. A cooling system comprising:

a refrigerator using gas; and a compressor configured to compress the gas returned from the refrigerator and supply the gas to the refrigerator, wherein the compressor comprises:

a heat exchanger configured to discharge heat generated during compression outside the compressor;

a cooling liquid inlet port through which cooling liquid flowing from outside the compressor into the compressor passes;

a cooling liquid outlet port through which the cooling liquid flowing out of the compressor from inside the compressor passes;

a first pipe configured to couple the cooling liquid inlet port to a cooling liquid receiving port of the heat exchanger;

a second pipe configured to couple the cooling liquid outlet port to a cooling liquid discharge port of the heat exchanger;

a first valve mounted in the first pipe and configured to regulate a flow of the cooling liquid through the first pipe;

a second valve mounted in the second pipe and configured to regulate a flow of the cooling liquid through the second pipe;

a third pipe configured to couple a port of the first valve toward the cooling liquid inlet port to a port of the second valve toward the cooling liquid discharge port;

a fourth pipe configured to couple a port of the first valve toward the cooling liquid receiving port to a port of the second valve toward the cooling liquid outlet port;

a third valve mounted in the third pipe and configured to regulate a flow of the cooling liquid through the third pipe; and a fourth valve mounted in the fourth pipe and configured to regulate a flow of the cooling liquid through the fourth pipe, wherein the compressor is configured such that an operation mode is switchable between a first mode in which the cooling liquid passing through the cooling liquid inlet port flows in the heat exchanger in a predetermined first direction and passes through the cooling liquid outlet port, and a second mode in which the cooling liquid passing through the cooling liquid inlet port flows in the heat exchanger in a second direction opposite to the first direction and passes through the cooling liquid outlet port, in the first mode, the first valve and the second valve allow passage of the cooling liquid and the third valve and the fourth valve restrict a flow of the cooling liquid, and, in the second mode, the third valve and the fourth valve allow passage of the cooling liquid and the first valve and the second valve restrict a flow of the cooling liquid.

9. A compressor configured to compress gas returned from a refrigerator and supply the gas to the refrigerator, comprising:

a heat exchanger configured to discharge heat generated during compression outside the compressor;

a cooling liquid inlet port through which cooling liquid flowing from outside the compressor into the compressor passes; and a cooling liquid outlet port through which the cooling liquid flowing out of the compressor from inside the compressor passes, wherein the compressor is configured such that an operation mode is switchable between a first mode in which the cooling liquid passing through the cooling liquid inlet port flows in the heat exchanger in a predetermined first direction and passes through the cooling liquid outlet port, and a second mode in which the cooling liquid passing through the cooling liquid inlet port flows in the heat exchanger in a second direction opposite to the first direction and passes through the cooling liquid outlet port, in the first mode, a first valve and a second valve allow a passage of the cooling liquid and a third valve and a fourth valve restrict a flow of the cooling liquid, and, in the second mode, the third valve and the fourth valve allow a passage of the cooling liquid and the first valve and the second valve restrict a flow of the cooling liquid, the compressor further comprises a control unit configured to switch the operation mode between the first mode and the second mode based on a result of measurement of a flow rate or a temperature of the cooling liquid, or measurements of both, the control unit switches the operation mode from the first mode to the second mode when the flow rate of the cooling liquid measured drops below a first predetermined threshold value, and switches the operation mode from the second mode to the first mode when the flow rate of the cooling liquid measured exceeds a second threshold value.

* * * * *